US005432489A

United States Patent [19]

Yrjölä

[11] Patent Number: 5,432,489

[45] Date of Patent: Jul. 11, 1995

[54] FILTER WITH STRIP LINES

[75] Inventor: Seppo Yrjölä, Oulu, Finland

[73] Assignee: LK-Products Oy, Kempele, Finland

[21] Appl. No.: 195,583

[22] Filed: Feb. 8, 1994

Related U.S. Application Data

[63] Continuation-in-part of Ser. No. 27,040, Mar. 5, 1993, abandoned.

[30] Foreign Application Priority Data

Mar. 9, 1992 [FI] Finland ..... 921025

[51] Int. Cl.[6] ..... H01P 1/20; H01P 1/205

[52] U.S. Cl. ..... 333/202; 333/206

[58] Field of Search ..... 333/202–207, 333/109, 116, 126, 134; 455/126, 82, 83

[56] References Cited

U.S. PATENT DOCUMENTS

| | | | |
|---|---|---|---|
| 3,560,887 | 2/1971 | Napoli et al. | 333/110 |
| 3,573,674 | 4/1971 | Wehner | 333/202 |
| 3,715,690 | 2/1973 | Young et al. | 333/202 X |
| 3,829,770 | 8/1974 | Stevens . | |
| 4,232,401 | 11/1980 | Chang et al. . | |
| 4,433,314 | 2/1984 | Hislop et al. . | |
| 4,706,049 | 11/1987 | Dydyk | 333/204 X |
| 5,103,197 | 4/1992 | Turunen et al. | 333/134 X |
| 5,111,165 | 5/1992 | Oldfield | 333/116 |
| 5,157,363 | 10/1992 | Puurunen et al. | 333/202 |
| 5,212,815 | 5/1993 | Schumacher | 455/126 |
| 5,230,093 | 7/1993 | Rich et al. | 455/126 |
| 5,252,934 | 10/1993 | Myer | 333/109 X |

FOREIGN PATENT DOCUMENTS

| | | |
|---|---|---|
| 0117676 | 9/1984 | European Pat. Off. . |
| 749337 | 5/1956 | United Kingdom . |
| 2156176 | 10/1985 | United Kingdom . |
| WO92/20163 | 11/1992 | WIPO . |

OTHER PUBLICATIONS

Inder Bahl et al., Microwave Solid State Circuit Design, 1988, cover page, contributors page, pp. 6–35 and pp. 198–209.

Reinmut K. Hoffmann, Handbook of Microwave Integrated Circuits, 1987, cover page, contents page and pp. 88–93.

Brian C. Wadell, Transmission line design handbook, 1991, cover page, pp. 62–63, 66–67, 70–71, 144–145, 148–151, 188–189, 244–245 and 248–249.

*Primary Examiner*—Seungsook Ham

*Attorney, Agent, or Firm*—Darby & Darby

[57] ABSTRACT

A filter (1) for filtering certain frequencies of an electric signal. The filter (1) comprises components (HX1–HX4) for forming the frequency response of the filter, and components (A,C) for accomplishing coupling and impedance matching. The filter is provided with a directional coupler (10) composed of two transmission lines (A,B), one of them being a coupling line (A) or an impedance matching line.

15 Claims, 3 Drawing Sheets

FILTER WITH STRIP LINES

CROSS-REFERENCE TO COPENDING APPLICATIONS

This is a continuation-in-part to U.S. patent application Ser. No. 08/027,040, filed Mar. 5, 1993, now abandoned.

BACKGROUND OF THE INVENTION

In the radio telephone industry, research and development has for a long time been aimed at the production of smaller, less expensive and more efficient units and components. This direction has lead to efficient exploitation of the available space on circuit board surfaces, to an increase in the degree of component integration, and towards rationalization of functions.

High frequency components of radio telephones constitute an exception to this trend. High frequency components have to date been extremely complex in construction, comprising discrete components and strip constructions.

It is known in the art to employ in the transmitter part of a radio telephone an output control circuit for controlling the output level of the transmission. The operation of the output control circuit is based on indications of the output level of the transmitter and comparison with a reference value. An essential part of the output control circuit is formed by a directional coupler, placed immediately adjacent the separation filter of the reception circuit, with which a voltage comparable with the output of the transmitter is produced. The directional coupler is therefore used for measuring the transmission output power, whereby the output level is controlled with the output control circuit. The directional coupler is usually located after the transmitter or before the antenna.

The directional coupler is conventionally constructed using various coupled transmission line constructions and transformers.

In U.S. Pat. No. 5,230,093 (Rich et al.), a transmitter filter with integral directional coupler for cellular telephones is disclosed. The filter includes both a transmitter signal filter and a directional coupler on a ceramic block of one or more pieces. The directional coupler is realized by two coupled transmission lines provided by two holes on the left side of the ceramic block and the transmitter filter is realized by five short-circuited coupled transmission lines provided by five holes on the right side of the ceramic block. The ceramic block is enlarged in order to provide two additional holes functioning as transmission lines to implement a directional coupler integral with the filter. The drawback of this implementation is that the size of the ceramic block has grown as a result of providing it with a directional coupler. As was stated before the aim of the radio telephone industry has been to reduce the size of the components, such as filters used in a radio telephone, and not to increase the size.

As is well known in the art, duplex filters composed of two separation filters and based on resonators are used to separate the signals to be transmitted and received. The duplex filter is therefore usually composed of two separate bandpass filters, one of them being connected to the receiver branch, its mean frequency and bandwidth corresponding to the receiving band, and the other filter being connected to the transmitter branch, its mean frequency and bandwidth corresponding to the transmission band. The other ends of the filters have frequently been connected to a common antenna line via a transmission line matching the impedance. Even though the duplex filter has frequently been accommodated within a single housing provided with terminals for transmitter, receiver and antenna, in practice it is composed of two separate bandpass filters because the isolation between the filters must be made as great as possible so that the electromagnetic leakages therebetween should not impede the functioning of the filter.

The filters constructed using the helix technique are provided with a metal partition between both of the filters, with which the required isolation is efficiently implemented. The couplings in duplex filters to the resonators and the couplings between the resonators have commonly been implemented by means of matching couplings formed by various transmission line constructions and discrete components. The bandpass filters of a dielectric, e.g., ceramic duplex filter, are usually implemented by two different ceramic blocks or by one block whereby the two bandpass filters are separated by one short circuiting strip line provided on one side of the ceramic block such as explained in U.S. Pat. No. 5,239,279.

A widely used directional coupler, having low manufacturing costs, can be constructed using microstrips or strip lines mounted directly on a telephone circuit board. Drawbacks of the structure include the relatively large circuit board area required and the high dependence of the operation on the properties of the circuit board substrate material and variations therein. The substrate material affects the dielectric insulation material losses of the microstrip line, these being greatly dependent on the so-called loss tangent of the material, and it affects the line losses, which are affected by the smoothness of the surface of the material. One example of implementing a directional coupler using strip lines has been explained and shown in U.S. Pat. No. 5,111,165 (Oldfield), which is incorporated herein by reference.

In order to reduce the costs, an advantageous general purpose material is frequently selected for the substrate material in radio telephones. The use of such a material causes deterioration in the functioning of the directional coupler constructed thereon. The increased material losses of the substrate material and the tolerances of the properties can be directly detected in the insertion attenuation of the directional coupler and in the variation of said properties.

By using a directional coupler design which is based on using separate transmission lines (e.g., coaxial cables), on a transformer, or by constructing the switch on a separate, stable or low loss substrate, these losses can be reduced and the operation stabilized. However, a plate area of at least the same size is needed, and in addition, the use of a separate substrate increases manufacturing costs.

SUMMARY OF THE INVENTION

According to the present invention there is provided a filter comprising filter means coupled to impedance matching means and coupling means for coupling the filter to external components, characterized by the filter comprising a directional coupler.

An advantage of the present invention is the avoidance of the previously mentioned drawbacks by removing the directional coupler from the substrate of the transmitter as a discrete component or strip structure and by forming the directional coupler as an integral part of the filter by adding only one strip line to the filter.

The present invention applies to both helical filters and dielectric filters. The basic idea of the present invention is to provide a second strip line adjacent a first strip line, which is necessary for the filter to function anyway and which thereby already is integral with the filter. For instance, such a strip line provides coupling from an input port to a resonator or from a resonator to an output port or coupling between two resonators of a filter. Alternatively, such a coupling provides impedance matching to an input or output port. The first and second strip lines realize a directional coupler. These strip lines are arranged, e.g., on one side of a ceramic filter block or on a printed board of a helical resonator filter so that they do not increase the size of the filter device as compared to the filter without a directional coupler. The strip lines may also be so called microstrips or suspended substrated lines. The same basic idea may be generally used for any kind of filter, such as a SAW filter (Surface Acoustic Wave), which has an insulating substrate with strip lines.

A filter in accordance with the present invention makes use of strip lines forming transmission lines in the couplings of the filter, such as a receiver (RX) or a transmitter (TX) separation filter, or in the matching circuits for implementing the directional coupler. With the aid of the invention, the directional coupler can be transferred from the circuit board substrate, frequently being a high-loss substrate and afflicted by environmental disturbances, into a high frequency filter. The high frequency filter offers an encapsulated environment protected against interference with a low-loss and stable substrate as required by a filter. Furthermore, since the directional coupler in accordance with the invention comprises a transmission line of a filter (the first strip line) and a switch transmission line (the second strip line) coupled thereto, the only additional losses caused by the coupler are of the magnitude of the output sample sampled by the transmitter system, which is a significant improvement as compared to conventional systems.

The directional coupler in accordance with the invention is relatively easy to implement by making use of the strip line components existing in the filter, such as coupling lines or impedance matching transmission lines. The directional coupler may be produced by adding a second microstrip e.g. in parallel with a first microstrip. The directional coupler may, in fact, be implemented in a great number of ways using different kind of transmission lines of strip line type, preferably microstrips, or suspended substrate lines. The manner of implementation may vary in accordance with the invention, but the essential feature is that a directional coupler is realized integral with the filter by adding one strip line and making use of the existing filter constructions.

A radio apparatus which is provided with both a transmitter and a receiver and in which the same antenna is used needs a transmission network for directing the signal to be transmitted and signal received appropriately.

The signal from the antenna must be directed to the receiver so that no significant interference is caused by the transmitter. Similarly, a signal from the transmitter must be transmitted to the antenna without causing any interference from the receiver.

BRIEF DESCRIPTION OF THE DRAWINGS

The invention is described below in more detail, by way of example with reference to the accompanying drawings, in which.

BRIEF DESCRIPTION OF THE INVENTION

Figure 1:
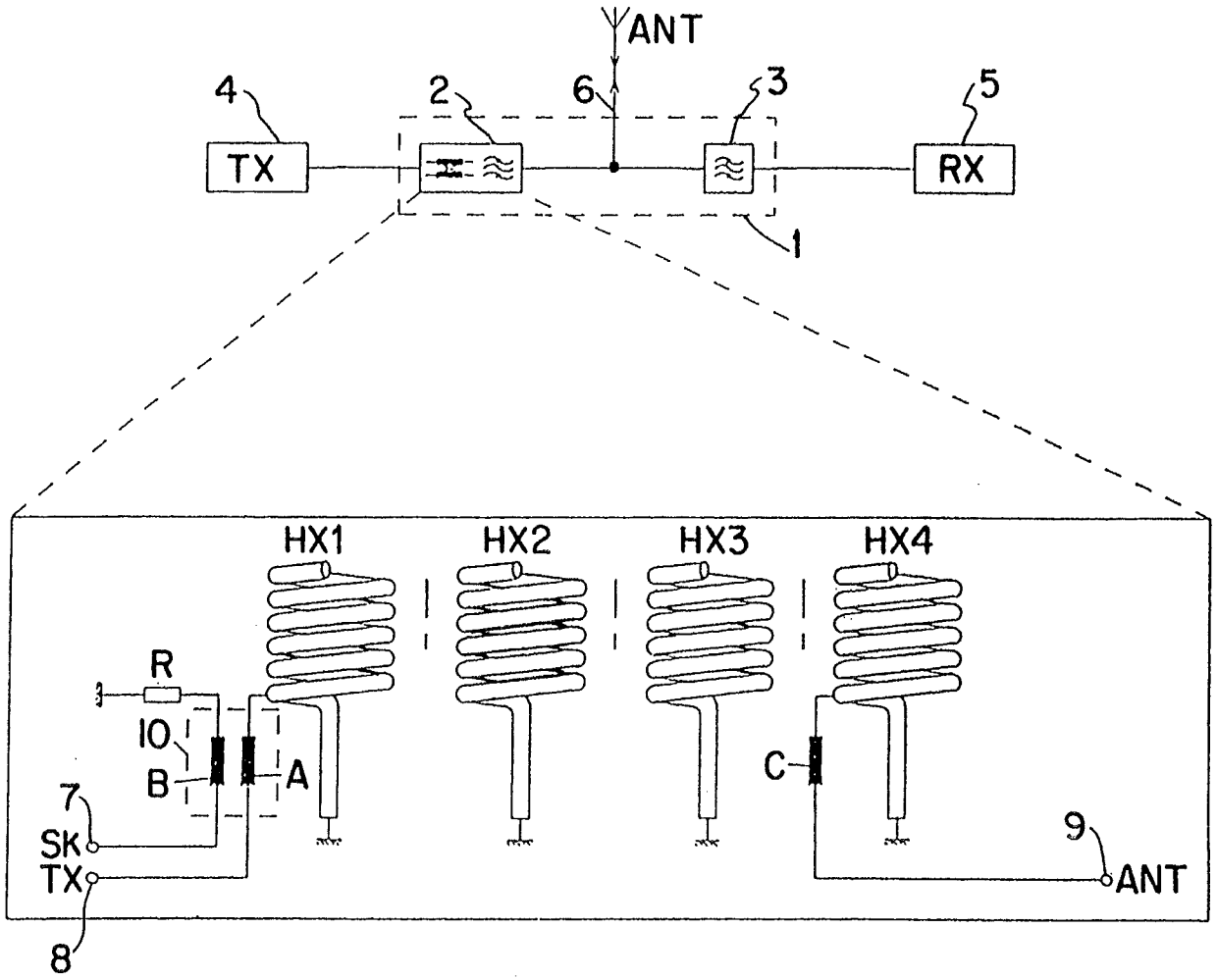
FIG. 1 is a schematic diagram of a filter comprising a filter-directional coupler block in accordance with the invention.

FIG. 1 shows schematically the coupling of a duplex filter 1 of a radio telephone to a transmitter block 4 and a receiver block 5. The duplex filter 1 comprises four ports: one port 8 for a transmission signal entering the filter, a port 9 for the antenna, a port (not shown) for the receiver 5, and a directional coupler port 7. A signal from the antenna 6 to be received propagates via the reception filter block 3 of the duplex filter 1 to the receiver 5. Respectively, a signal from the transmitter 4 propagates through the receiver (RX) separation filter block 2 of the duplex filter 1 to antenna 6. From the signal proceeding to the antenna, the directional coupler 10 takes a sample of a given level, comparable with the output level of the transmitter, and transmits it to the directional coupler port 7.

FIG. 1 illustrates the integration of a directional coupler 10 in the matching circuit at the transmitter end of the RX separation filter 2 of the duplex filter 1. The directional coupler 10 has preferably been implemented on a circuit board using coupled microstrips. One of the strips, strip A, serves as a coupling strip for the filter input to resonator HX1. The other one of the strips, strip B, serves as a coupling strip to the directional coupler port 7. The coupler strip B ends in a resistor R. In the filter of the FIG. 1, the directional coupler could be positioned adjacent the antenna port 9, whereby it could be easily implemented by adding another branch next to strip C which carries out the impedance matching. The additional branch would comprise a directional coupler port 7, a coupler transmission line, comparable to line B, and an end resistor R.

The directional coupler 10 is preferably composed of two adjacent microstrips A and B provided with common ground planes. Electromagnetic coupling exists between the strips: a voltage in one strip producing an electric field which induces a voltage also in the other strip. Magnetic coupling is likewise caused by a magnetic field provided by the current propagating in the strip, said field inducing a current also into the other strip. When power is transferred from the transmitter block 4 to port 8, the desired part of the power, which is determined by the coupling, is coupled to the directional coupler port 7. Also, another part thereof passes through the coupler 10 towards a first resonator HX1 of the filter, and a very small leakage part caused by the non-homogeneity and quasi transverse electric and magnetic (TEM) waveform of the switch is short circuited via the end resistor R to the ground. The microstrip coupler 10 described above is bilateral, i.e. any power carried to any port will be coupled in the same way, because of the symmetry.

The proportions of the quasi TEM directional waveform in the coupler is generally used as a quality measure. In other words, comparison of the power at directional coupler port 7 and the power at the insulated leakage port leading to ground via resistor R provides a measure of quality.

Even though the resonators HX1–HX4 of FIG. 1 have been shown as helically wound conductors, the resonators HX1–HX4 may be a different kind of transmission line resonator, such as helical, coaxial, dielectric, waveguide, cavity, ceramic, etc.

Figure 2A:
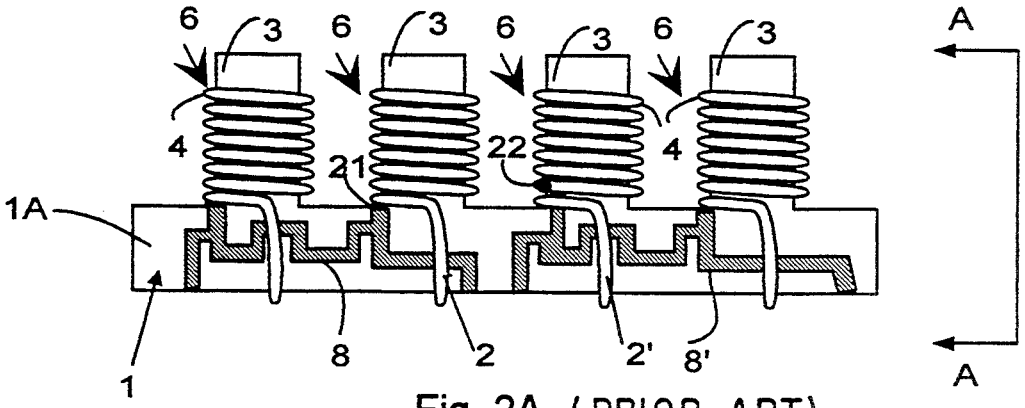
Fig. 2A (PRIOR ART)
FIG. 2A shows a front view of a prior art filter comprising helical resonators attached to a printed board.
Figure 2B:
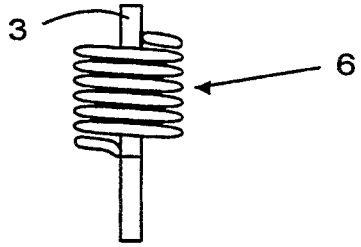
Fig. 2B (PRIOR ART)
FIG. 2B illustrates the structure of FIG. 1 seen in the direction A—A.

Helical resonator filters having a comb type structure have been disclosed in U.S. Pat. Nos. 4,977,383 and 5,047,739. Such a helical resonator filter is shown in FIGS. 2A and 2B and comprises four discrete helix resonators 6 wound of metal wire 4 into cylindrical coils. Each resonator is arranged around projections 3 formed in a printed board 1 made of electrically insulating material. The whole structure thereby forms a comb like structure. The bottom part 1A of the printed board 1 is provided with an electrical circuit formed by strip lines 8 and 8', to which circuit the resonators 6 are connected in an electrically conductive manner, e.g., by soldering, at points indicated with the reference numerals 21 and 22. Each resonator 1 may further be connected mechanically to the projection 3 by soldering to a metallized point on the projection (not shown in the figure).

Figure 2C:
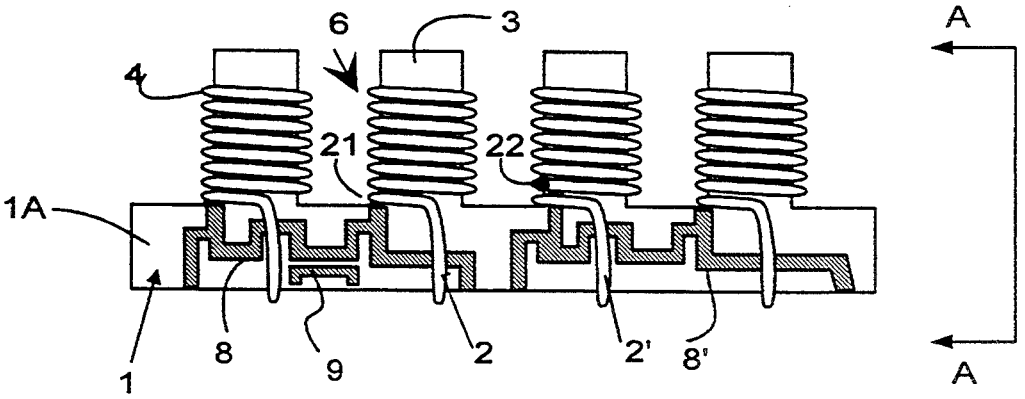
FIG. 2C shows a front view of a filter of FIG. 2A with an implementation of the present invention.
Figure 2D:
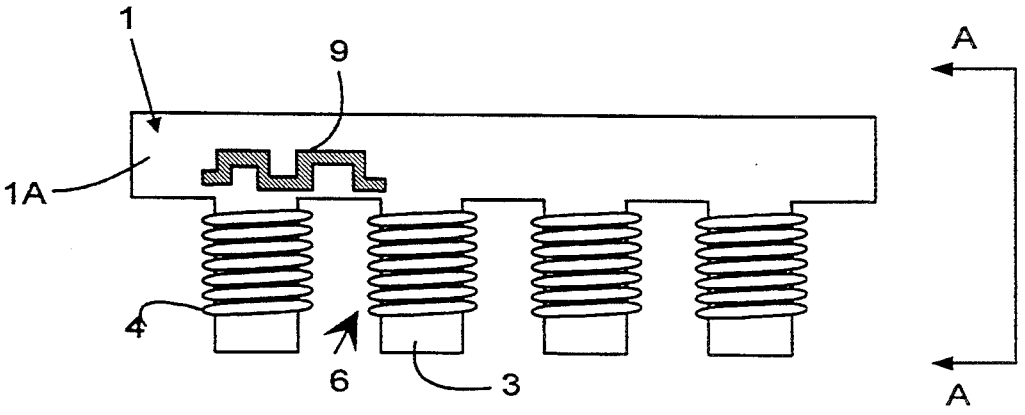
FIG. 2D shows an upside down back view of a filter of FIG. 2A with an implementation of the present invention.

Now, as shown in FIG. 2C according to the present invention, a second strip line 9 is disposed on the printed board 2 adjacent a first strip line 8, which, e.g., connects two resonators to each other and which already is part of the helix resonator filter structure of FIG. 2A. Part of the signal transferred via strip line 8 is coupled to the second strip line 9, and the first and the second strip line that are disposed adjacent each other implement a directional coupler. The directional coupler may also be implemented by providing the second strip line 9 adjacent the first strip line 8, but on the other side of the printed board 1. This has been shown in FIG. 2D, which illustrates an upside down turned back view of the helix resonator filter of FIGS. 2A and 2B, of which FIG. 2A shows a front view. A filter device comprising a helix resonator filter and a directional coupler has thereby been implemented by the addition of one strip line 9 as shown in FIGS. 2C and 2D without increasing the size of the filter device as compared to the filter of FIG. 2A.

The invention is not restricted to the type of helix filter shown in FIGS. 2A–2D, also another type of helix filter may be used which has an electrically insulating substrate with strip lines for providing electrical signal coupling to or from a resonator. Also, the strip lines may be so called microstrips or suspended substrate lines.

Figure 3A:
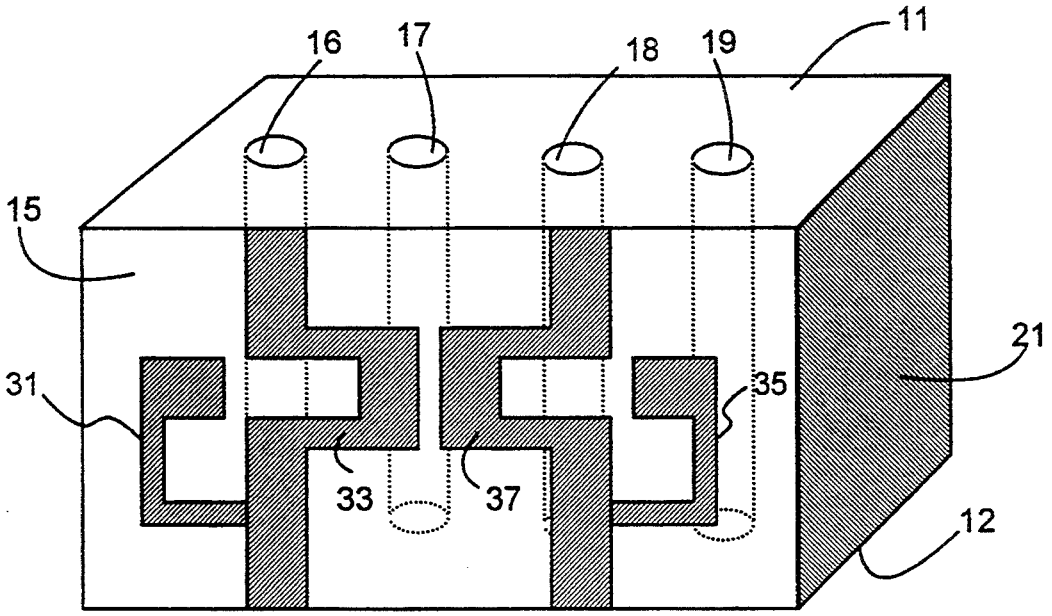
Fig. 3A (PRIOR ART)
FIG. 3A shows a prior art dielectric filter.

In U.S. Pat. No. 5,103,197 a dielectric filter is disclosed which is formed from a block of ceramic material with holes extending from a top surface toward a bottom surface. At least the bottom, both ends and one side surface are coated with conductive material. Also, the interior surfaces of the holes are coated with conductive material to form transmission line resonators. The uncoated side surface has an electrode pattern which allows coupling to the filter and between resonators of the filter. FIG. 3A illustrates such a type of dielectric filter and the electrode pattern coupling design of the uncoated side surface 15. Inductive coupling to or from a resonator is achieved by an electrode strip design that is positioned adjacent the resonator at about the midpoint of its height. A portion of the strip extends to the conductive layer on the bottom surface 12 of the body. This kind of inductive coupling design is illustrated by coupling designs 31 and 35 which are adjacent the endmost resonators 16, 19. Lateral ground strip electrode designs 33 and 37 are also located on the side surface 15. These strips 33, 37 extend from the conductive layer 21 on the top surface to the conductive layer 21 on the bottom surface 12. Ground strip electrodes 33, 37 are offset toward holes 17 and 18, respectively. These strips tend to control the capacitive coupling between resonators. The inductive input/output strips 31, 35 are connected to respective ground strips 33, 37 near the bottom surface 12.

Figure 3B:
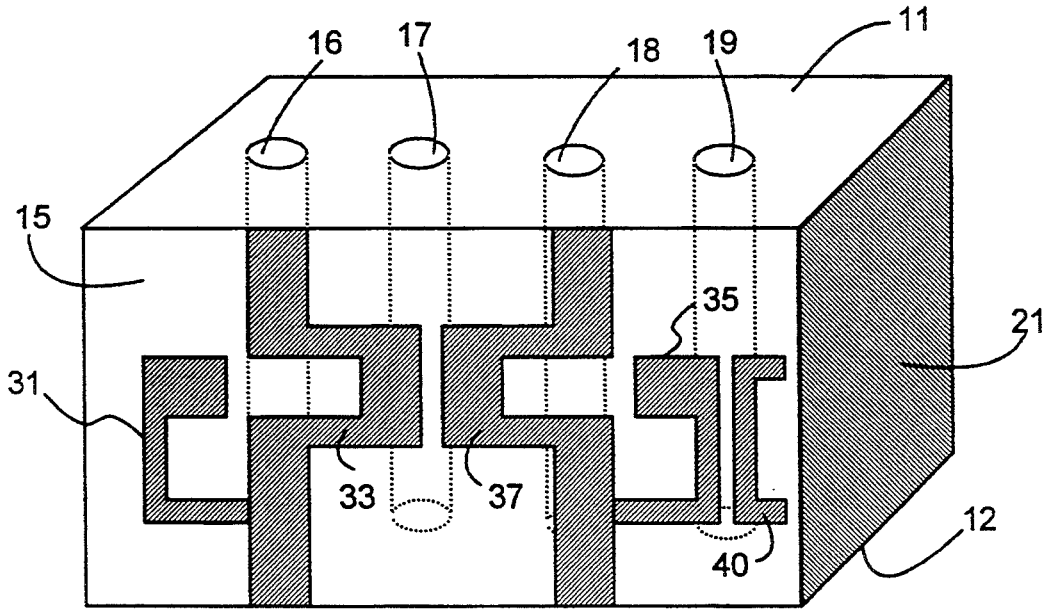
FIG. 3B shows an implementation of the present invention in a dielectric filter of FIG. 3A.

FIG. 3B illustrates a second strip line 40 disposed on the uncoated side surface 15 adjacent an input/output strip 35. Part of the signal transferred via strip line 35 is coupled to the second strip line 40, and the first and second strip line disposed adjacent each other implement a directional coupler. A filter device comprising a ceramic filter and a directional coupler has thereby been implemented by the addition of one strip line 40 as shown in FIG. 3B without increasing the size of the filter device compared to the filter of FIG. 3A.

The invention is not restricted to the type of dielectric filter shown in FIGS. 3A and 3B, also other types of dielectric filters may be used which have a surface with strip lines for providing electrical signal coupling to or from a resonator, such as a dielectric filter having input and output port strip line connections arranged at the top surface as disclosed in U.S. Pat. No. 4,431,977. Here also, the strip lines may be so called microstrips or suspended substrate lines.

By using an integrated filter and directional coupler design in accordance with the invention in the duplex filter of a radio telephone, losses caused in the transmitter part of the radio telephone by the directional coupler can be reduced significantly, the operation of the radio telephone stabilized, and the use of the telephone substrate area enhanced.

The specification has identified some types of strip lines, but all different kinds of transmission lines using a strip line may be used for the present invention. Also, using a thin wire of electrically conductive material having a round cross-section instead of a flat strip line may be employed. In this connection, reference is made to the publication of Wadell, "Transmission Line Design Handbook", pages 148–151, which discloses thin wires as transmission lines. The thin round wire is disposed on the surface of a substrate of electrically insulating material. Further, any combination of different types of wave conductors or transmission line resonators may be used on a common substrate as the two strip lines, whether microstrips, dielectric, suspended substrate lines, waveguides, coaxial, cavity, ceramic, etc.

"Strip lines" is common name for all wave conducts or transmission line resonators, where there is at least one strip-shaped electrode and one planar electrode, as mentioned in the publication by Hoffman, "Handbook of Microwave Integrated Circuits", page 88. Another common name is planar transmission line, as discussed in Bahl, Bhartia, "Microwave Solid State Circuit Design", page 13.

In view of the foregoing it will be clear to a person skilled in the art that modifications may be incorporated without departing from the scope of the present invention.

What is claimed is:

1. A filter device comprising:

a filter with at least two resonators for filtering certain frequencies of an electrical signal, a substrate of electrically insulating material separating said resonators from each other, and at least one first strip line disposed on said substrate for coupling a signal which is one of being transmitted to and transmitted from one of said resonators, one end of said first strip line being coupled to one of said resonators and the other end of said first strip line being coupled to one of an input and output port of said filter; and a second strip line disposed on said substrate adjacent said first strip line for electromagnetically coupling therebetween, said first and second strip lines forming a directional coupler and one end of said second strip line being coupled to an output port to which a portion of the signal coupled to said first strip line is coupled.

2. A filter device according to claim 1, wherein the filter is a dielectric filter.

3. A filter device according to claim 2, wherein the dielectric filter comprises a body of dielectric material as said substrate, said body having at least two holes extending from a top surface to a bottom surface of said body, a conductive layer covering a major portion of said body and interiors of the holes, except for one side face of the body which is substantially uncoated, so as to form at least two transmission line resonators, and an electrically conductive electrode pattern comprising said first and second strip lines.

4. A filter device according to claim 1, wherein the filter is a helix filter.

5. A filter device according to claim 4, wherein the helix filter comprises a printed board of electrically insulating material as said substrate, at least two helically wound electrical conductors having a low impedance end and a high impedance end, at least one of said helically wound electrical conductors being wound around said printed board, and at least part of said printed board comprising an electrical circuit formed by said first and second strip lines.

6. A filter device comprising:

a filter with at least two resonators for filtering certain frequencies of an electrical signal and a substrate of electrically insulating material separating said two resonators from each other and on which at least one first strip line is disposed for coupling said two resonators to each other, one end of said first strip line being coupled to a first of said resonators and the other end of said first strip line being coupled to a second of said resonators; and a second strip line disposed on said substrate of electrically insulating material adjacent said first strip line for electromagnetically coupling therebetween, said first and second strip lines forming a directional coupler and one end of said second strip line being coupled to an output port to which part of the signal power of said electrical signal coupled via said first strip line is coupled.

7. A filter device according to claim 6, wherein the filter is a dielectric filter.

8. A filter device according to claim 7, wherein the dielectric filter comprises a body of dielectric material as said substrate, said body having at least two holes extending from a top surface to a bottom surface of said body, a conductive layer covering a major portion of said body and interiors of the holes, except for one side face of the body which is substantially uncoated, so as to form at least two transmission line resonators, and an electrically conductive electrode pattern comprising said first and second strip lines.

9. A filter device according to claim 6, wherein the filter is a helix filter.

10. A filter device according to claim 9, wherein the helix filter comprises a printed board of electrically insulating material as said substrate, at least two helically wound electrical conductors having a low impedance end and a high impedance end, at least one of said helically wound electrical conductors being wound around said printed board, and at least part of said printed board comprising an electrical circuit formed by said first and second strip lines.

11. A filter device comprising:

a filter comprising at least two resonators for filtering certain frequencies of an electrical signal and a substrate of electrically insulating material separating said two resonators from each other and on which at least one first strip line is disposed, one end of said first strip line being coupled to one of said resonators and the other end of said first strip line being coupled to one of an input port and output port of said filter for impedance matching an input or output port of said filter to one of said resonators; and a second strip line disposed on said substrate adjacent said first strip line for electromagnetically coupling therebetween, said first and second strip lines forming a directional coupler and one end of said second strip line being coupled to an output port to which part of the signal power of said electrical signal coupled to said first strip line is coupled.

12. A filter device according to claim 11, wherein the filter is a dielectric filter.

13. A filter device according to claim 12, wherein the dielectric filter comprises a body of dielectric material as said substrate, said body having at least two holes extending from a top surface to a bottom surface of said body, a conductive layer covering a major portion of said body and interiors of the holes, except for one side face of the body which is substantially uncoated, so as to form at least two transmission line resonators, and an electrically conductive electrode pattern comprising said first and second strip lines.

14. A filter device according to claim 11, wherein the filter is a helix filter.

15. A filter device according to claim 14, wherein the helix filter comprises a printed board of electrically insulating material as said substrate, at least two helically wound electrical conductors having a low impedance end and a high impedance end, at least one of said helically wound electrical conductors being wound around said printed board, and at least part of said printed board comprising an electrical circuit formed by said first and second strip lines.

* * * * *